United States Patent [19]

Cohen

[11] Patent Number: 4,919,051

[45] Date of Patent: Apr. 24, 1990

[54] PROXIMITY DETECTOR MINE SYSTEM

[76] Inventor: David Cohen, D. N. Emek Ayalon, Moshay Ben Nun, Israel

[21] Appl. No.: 357,936

[22] Filed: May 26, 1989

[30] Foreign Application Priority Data

May 27, 1988 [IL] Israel ..... 86525

[51] Int. Cl.[5] ..... F42B 23/04; F42C 13/06

[52] U.S. Cl. ..... 102/404; 102/211; 102/427

[58] Field of Search ..... 102/404, 427, 401, 211

[56] References Cited

U.S. PATENT DOCUMENTS 2,341,351 2/1944 Barkley ..... 102/401
3,754,508 8/1973 Dalton ..... 102/401
3,838,642 10/1974 Shimberg ..... 102/404
4,408,533 10/1983 Owen et al. ..... 102/427

*Primary Examiner*—Charles T. Jordan
*Attorney, Agent, or Firm*—Benjamin J. Barish

[57] ABSTRACT

A proximity detector mine system comprises a mine depolyable on the ground and including a propellant device effective upon actuation to propel the mine above the ground, explosive material, a detonator for detonating the explosive material a predetermined time after the propellant has been actuated, a sound sensor producing electrical signals in response to the sound sensed thereby, and a processor for processing the electrical signals and for actuating the propellant device in response to the electrical signals received from the sound sensor.

18 Claims, 3 Drawing Sheets

FIG 1
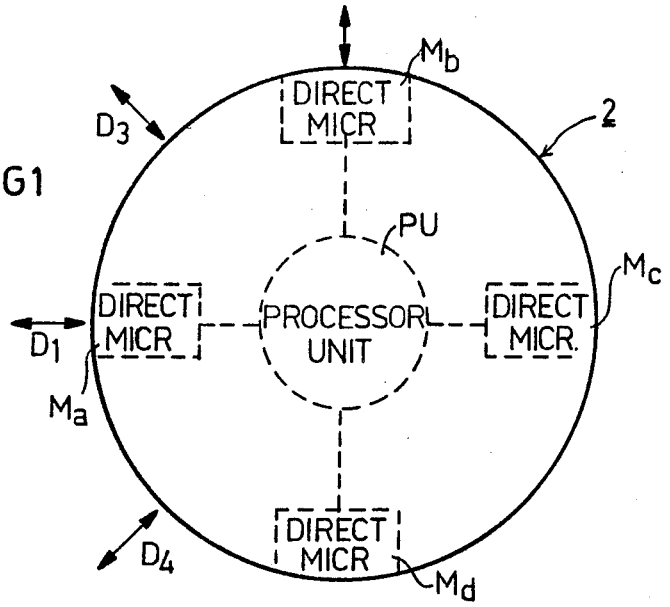
FIG 2
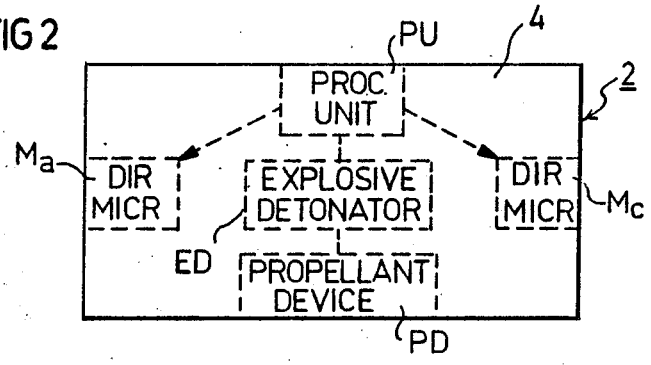
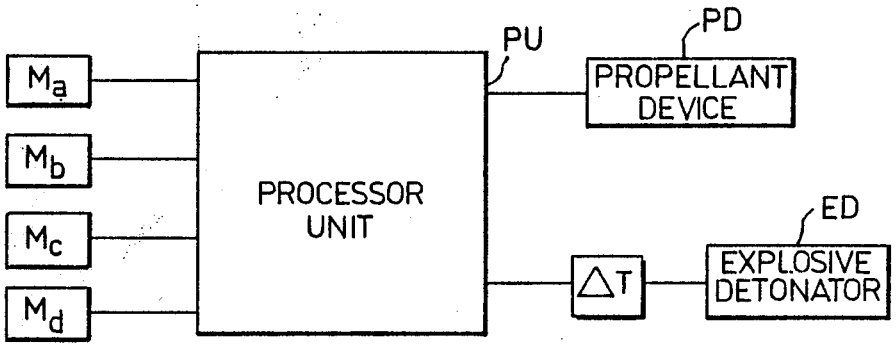
FIG 3

PROXIMITY DETECTOR MINE SYSTEM

BACKGROUND OF THE INVENTION

The present invention relates to a proximity detector mine system for use against approaching targets. The invention is particularly applicable for use against helicopters, and is therefore described below with respect to this application.

While many different types of mine systems have been devised against approaching personnel, land vehicles, and sea vehicles, insofar as we are aware no mine system has yet been devised effective against approaching helicopters. An object of the present invention is to provide a proximity detector mine system which is particularly, but not exclusively, applicable with respect to approaching helicopters.

OBJECTS AND SUMMARY OF THE INVENTION

According to the present invention, there is provided a proximity detector mine system comprising a a mine deployable on the ground and including a propellant device effective upon actuation to propel the mine above the ground, explosive material, a detonator for detonating the explosive material a predetermined time after the propellant has been actuated, sound sensing means comprising a plurality of directional microphones oriented in different directions producing electrical signals in response to the sounds sensed thereby, and a processor for processing the electrical signals and for actuating the propellant device in response to the electrical signals received from the sound sensing means.

The propellant device for propelling the mine above the ground may be of a type presently used in "jumping mines" which, upon actuation, propel the mine a few meters above the ground before the explosive is detonated by the detonator. In the case of the present invention, however, the propellant device should propel the mine a distance of approximately fifty meters above the ground in order to make the explosive more effective against helicopters. Such a propellant device may be another explosive, or a jet-type device, effective upon actuation to propel the mine above the ground a distance of the order of fifty meters. When the mine reaches this height, as determined for example by a predetermined time delay device, the detonator is actuated for detonating the explosive material within the mine, thereby making the mine effective against low-flying helicopters.

In the preferred embodiment of the invention described below the processor includes recognition means for recognizing the sounds of a helicopter and for actuating the propellant device in response thereto.

According to further features in the described preferred embodiment, the sound sensing means comprises a plurality (e.g., four) directional microphones oriented at equal angular distances (e.g., 90°) with respect to each other. The processor actuates the propellant device when the sound from one microphone is substantially equal to that of the microphone oriented 180° with respect thereto, or when the sum of the sounds from two adjacent microphones is substantially equal to that of the other two microphones.

Also described below is a proximity detector mine system comprising a plurality of such mines deployable on the ground, and a central processor including means for selectively disabling all the mines. Such an arrangement enables the central processor to disable a mine field when, for example, it is to be overflown by friendly helicopters or to be occupied by friendly ground forces.

According to a further feature in the latter described embodiment, the central processor also includes means for enabling the mines sequentially at predetermined time intervals, e.g., every two seconds. Such an arrangement makes the system more effective particularly when there are a plurality of helicopters, since it prevents all the mines from being detonated by the first-arriving helicopter.

Further features and advantages of the invention will be apparent from the description below.

BRIEF DESCRIPTION OF THE DRAWINGS

The invention is herein described, by way of example only, with reference to the accompanying drawings, wherein:

FIGS. 1 and 2 are top and side elevational views, respectively, diagrammatically illustrating one form of mine constructed in accordance with the present invention;

FIG. 3 is a block diagram of the electrical circuit in the mine of FIGS. 1 and 2;

DESCRIPTION OF PREFERRED EMBODIMENTS

The mine illustrated in FIGS. 1 and 2 comprises a casing, generally designated 2, housing explosive material 4 and an explosive detonator, diagrammatically illustrated by box ED, for detonating the explosive material. The mine further includes a propellant device, diagrammatically illustrated by box PD, which is effective, upon actuation, to propel the mine above the ground before the explosive material is detonated. In the described example, propellant device PD, which may be another explosive charge as mentioned above, should be effective to propel the mine a distance of about fifty meters above the ground in order to make the mine effective against helicopters.

The mine illustrated in FIGS. 1 and 2 further includes four directional microphones, as schematically indicated at Ma, Mb, Mc, Md, oriented 90° with respect to each other. The mine further includes a processor unit PU which processes the electrical signals produced by the microphones Ma-Md and actuates the propellant device PD when the electrical signals received from the microphones indicate that a helicopter is at a predetermined location over the respective mine. Actuation of the propellant device PD propels the mine upwardly above the ground, and after a predetermined time interval the detonator ED is actuated to detonate the explosive material within the mine, as shown by the block diagram in FIG. 3.

Figure 4:
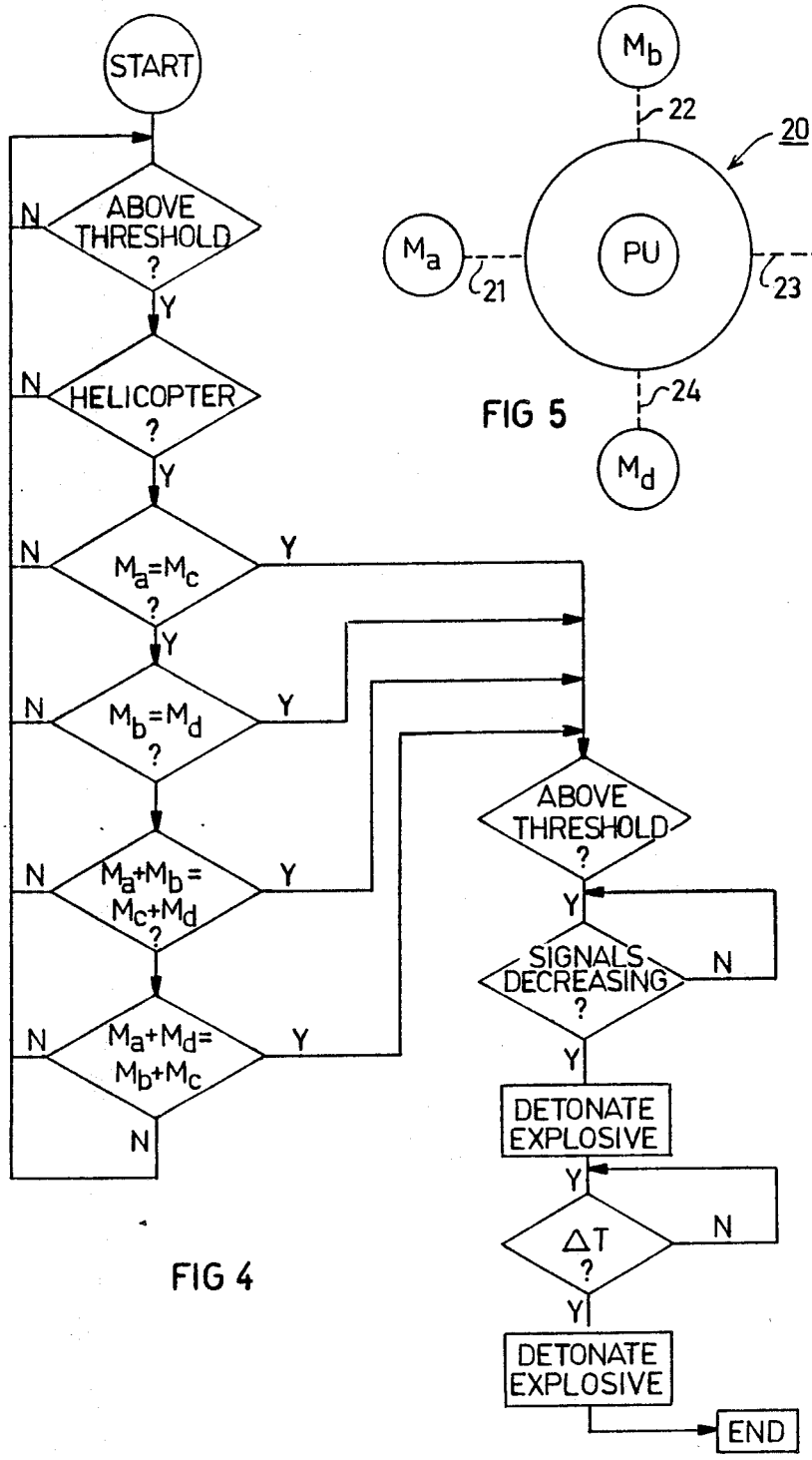
FIG. 4 is a flow diagram illustrating the operation of the processor in the electrical circuit of FIG. 3.

The processor unit PU within the mine is one programmed to perform the operations as illustrated by the flow diagram of FIG. 4.

Thus, the program first checks to see whether the electrical signals produced by the four directional microphones Ma-Md are above a threshold, and if so, the program checks to determine whether these sounds are of the type produced by a helicopter. The sounds of a helicopter are quite distinctive, and therefore can be relatively easily identified by appropriate logic or correlation circuitry, either within the processor unit PU or externally thereof, enabling the pattern of electrical signals produced by the microphones to be compared with a reference pattern corresponding to the sounds produced by helicopters.

After the processor unit PU has identified the picked-up sounds as being those of a helicopter, the program in the processor unit PU then continuously checks to see whether the sound received from one microphone is substantially equal to that received from the microphone oriented 180° with respect thereto, or whether the sum of the sounds from two adjacent microphones is substantially equal to that of the other two microphones. When any one of the above conditions has been found to be true, the program then tests to determine that the received sounds are above a predetermined threshold. When this is also true, it tests to determine when the sound signals tend to decrease, thus indicating the target is closest to the mine, and when this occurs it actuates the propellant device PD. This causes the mine to be propelled above the ground, and after a predetermined time delay, e.g., equal to the time for the mine to reach a height of about fifty meters, the detonator ED is actuated to detonate the explosive, thereby increasing the chances of destroying or damaging the incoming helicopters.

It will thus be seen that the program illustrated in FIG. 4 permits the detonator to be actuated when the sound from one microphone is substantially equal to that of the microphone oriented 180° with respect thereto, or when the sum of the sounds from two adjacent microphones is substantially equal to that of the other two microphones. These conditions better assure that the mine will not be detonated except by a helicopter approaching the mine from any one of the four directions $D_1$–$D_4$ in FIG. 1, and that the helicopter will be at a predetermined location over the mine before the mine is detonated. Thus, in the flow diagram of FIG. 4, condition $Ma=Mc$ makes the mine particularly sensitive to helicopters approaching in the direction $D_1$ of FIG. 1; condition $Mb=Md$ makes it particularly sensitive in the direction $D_2$; condition $Ma+Mb=Mc+Md$ makes it particularly sensitive in the direction $D_3$; and condition $Ma+Md=Mb+Mc$ makes it particularly effective in the direction $D_4$.

The foregoing arrangement thus not only better assures that the mine will not be actuated until a helicopter is at a predetermined location with respect to the mine, but also better prevents a counter-measure actuation of the mines by an enemy using a sound generator located at a distance and simulating the sounds of a helicopter.

Figure 5:
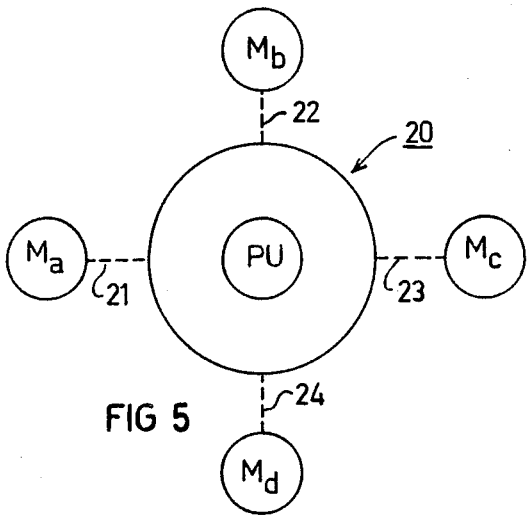
FIG. 5 illustrates a modification in the construction of the mine of FIGS. 1 and 2.

In the mine illustrated in FIGS. 1 and 2, the directional microphones Ma-Md are carried by the mine itself. FIG. 5 illustrates a modification, wherein the four microphones Ma-Md are connected to the mine housing, therein designated 20, by electrical conductors 21–24, respectively, to enable the microphones to be located at predetermined distances from the mine. In all other respects, the construction and operation of the mine illustrated in FIG. 5 may be the same as described above with respect to FIGS. 1–4.

Figure 6:
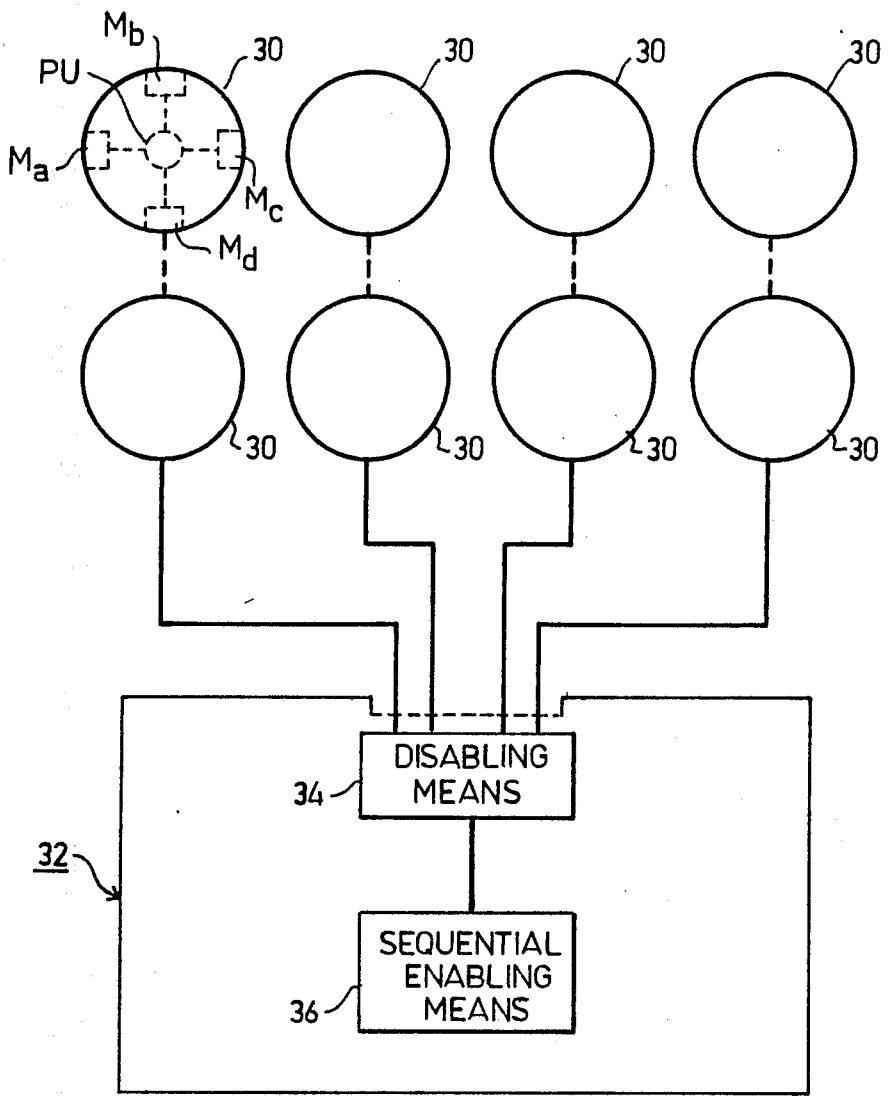
FIG. 6 illustrates a proximity detector mine system according to the present invention but including a plurality of mines deployable on the ground or controlled by a central processor.

FIG. 6 illustrates a further embodiment of the invention, wherein the system includes a plurality of mines, each indicated at 30, deployable on the ground, and a central processor, generally designated 32, connected to all the mines. Each of the mines 30 is constructed as described above with respect to FIGS. 1–5, including four directional microphones Ma-Md, a propellant device PD, an explosive detonator ED, and a processor unit PU controlling each mine as described above. In the embodiment of FIG. 6, however, the processor unit PU of each mine is connected, either by a wire or by wireless, to the central processor 32.

The central processor 32 includes a disabling circuit 34 for selectively disabling all the mines, e.g., when the respective area is to be overflown by friendly aircraft or to be occupied by friendly ground forces. The central processor 32 further includes a sequential enabling circuit 36, which sequentially enables each of the mines 30 at predetermined intervals, e.g., each two seconds. The purpose of the latter circuit is to prevent all the mines from being actuated at one time upon the approach of the first one of a plurality of helicopters and thereby make the mine system more effective against a plurality of helicopters. The sequential firing arrangement also increases the possibility of destroying or damaging a single helicopter.

While the invention has been described with respect to several preferred embodiments, it will be appreciated that many variations may be made. For example, the system could include a central microphone network controlling a plurality of mines. Also, there could be fewer than four microphones, e.g., one or two, or more microphones, e.g., five or six, all equally spaced in a circular array. Further, each mine could include a disabling circuit enabling a friendly aircraft or ground vehicle to disable the mine by a radio-transmitter disabling signal.

Many other variations, modifications and applications of the invention will be apparent.

What is claimed is:

1. A proximity detector mine system, comprising: a mine deployable on the ground and including a porpellant device effective upon actuation to propel the mine above the ground, explosive material, a detonator for detonating the explosive material a predetermined time after the propellant has been actuated, sound sensing means producing electrical signals in response to the sound sensed thereby, and a processor for processisng said electrical signals and for actuating the propellant device in response to the electrical signals received from the sound sensing means; said sound sensing means comprising a plurality of directional microphones oriented in different directions.

2. The system according to claim 1, wherein said processor includes recognition means for recognizing the sound of a helicopter and for actuating said propellant device in response thereto.

3. The system according to claim 1, wherein said sound sensing means comprises four directional microphones oriented 90° with respect to each other.

4. The system according to claim 3, wherein said processor actuates said propellant device when the sound from one microphone is substantially equal to that of the microphone oriented 180° with respect thereto, or when the sum of the sounds from two adjacent microphones is substantially equal to that of the other two microphones.

5. The system according to claim 1, wherein said directional microphones are carried by the mine.

6. The system according to claim 1, wherein said directional microphones are connected to the mine by electrical conductors enabling each microphone to be located a distance from the mine.

7. A proximity detector mine system comprising a plurality of mines, each according to claim 1, deployable on the ground, and a central processor including means for selectively disabling all the mines.

8. The system according to claim 7, wherein said central processor also includes means for enabling said mines sequentially at predetermined time intervals.

9. The system according to claim 8, wherein said predetermined time intervals are approximately every two seconds.

10. A proximity detector mine system, comprising: a plurality of mines deployable on the ground; each of said mines including a propellant device effective upon actuation to propel the mine above the ground, explosive material, a detonator for detonating the explosive material a predetermined time after the propellant has been actuated, sound sensing means producing electrical signals in response to the sound sensed thereby, and electrical circuit means for processing said electrical signals and for actuating the propellant device in response to the electrical signals received from the sound sensing means; and a central processor including means for selectively disabling all the mines.

11. The system according to claim 10, wherein said central processor also includes means for enabling said mines sequentially at predetermined time intervals.

12. The system according to claim 11, wherein said predetermined time intervals are approximately every two seconds.

13. The system according to claim 10, wherein said electrical circuit means includes recognition means for recognizing the sounds of a helicopter and for actuating said propellant device in response thereto.

14. The system according to claim 10, wherein said sound sensing means comprises a plurality of directional microphones oriented in different directions.

15. The system according to claim 14, wherein said sensing means comprises four directional microphones oriented 90° with respect to each other.

16. The system according to claim 15, wherein said processor actuates said propellant device when the sound from one microphone is substantially equal to that of the microphone oriented 180° with respect thereto, or when the sum of the sounds from two adjacent microphones is substantially equal to that of the other two microphones.

17. The system according to claim 14, wherein said directional microphones are carried by the mine.

18. The system according to claim 14, wherein said directional microphones are connected to the mine by electrical conductors enabling each microphone to be located a distance from the mine.

* * * * *